US005941412A

United States Patent [19]

Mahoney

[11] Patent Number: 5,941,412

[45] Date of Patent: Aug. 24, 1999

[54] DETACHABLE HINGE SYSTEM FOR CONTAINERS

[76] Inventor: Gwendolyn Mahoney, 8021 Rugby St., Philadelphia, Pa. 19150

[21] Appl. No.: 09/038,609

[22] Filed: Mar. 11, 1998

[51] Int. Cl.[6] ..... B65D 51/04

[52] U.S. Cl. ..... 220/847; 220/845

[58] Field of Search ..... 220/845, 847

[56] References Cited

U.S. PATENT DOCUMENTS

| | | | |
|---|---|---|---|
| 2,507,965 | 5/1950 | Eichner | 220/847 X |
| 3,257,022 | 6/1966 | Robinson . | |
| 3,592,354 | 7/1971 | Nielsen | 220/847 |
| 4,896,786 | 1/1990 | Schupack et al. | 220/338 |
| 5,065,878 | 11/1991 | Altmann et al. | 220/3.8 |
| 5,148,912 | 9/1992 | Nozawa . | |
| 5,381,920 | 1/1995 | Lin | 220/342 |
| 5,489,035 | 2/1996 | Fuchs . | |
| 5,540,343 | 7/1996 | Schumacher . | |
| 5,541,813 | 7/1996 | Satoh et al. | 220/847 X |
| 5,603,402 | 2/1997 | Cuneo | 220/847 X |

*Primary Examiner*—Stephen K. Cronin
*Attorney, Agent, or Firm*—Henderson & Sturm

[57] ABSTRACT

A detachable hinge system 10 for containers, including a receptacle member 20 having an upper lip portion 21 provided with a contoured recess 23, a lid member 30 having a lower lip portion 31 provided with a contoured recess 33 and a hinge member 40, including a flexible strap portion 41 wherein the opposite ends of the flexible strap portion 41 are provided with protrusions 42, 42 that are dimensioned to be releasably received in the recesses 23, 33.

5 Claims, 1 Drawing Sheet

DETACHABLE HINGE SYSTEM FOR CONTAINERS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of plastic containers in general, and in particular to a novel hinge system for connecting the lid of the container to the receptacle of the invention.

2. Description of Related Art

As can be seen by reference to the following U.S. Pat. Nos. 3,257,022; 5,148,912; 5,489,035; and 5,540,343, the prior art is replete with myriad and diverse hinge constructions that connect a container lid to a container receptacle.

While all of the aforementioned prior art constructions are more than adequate for the basic purpose and function for which they have been specifically designed, they are uniformly deficient with respect to their failure to provide a simple, efficient, and practical detachable hinge system for plastic containers and the like that will allow the lid and the receptacle of the containers to be selectively connected and disconnected to one another by a removable hinge member.

As anyone who uses plastic containers is all too well aware, there are certain times that you want a hinge member to be provided so that the lid does not become separated from the receptacle during use or the hinge member can be used to suspend the container from a support during storage, and there are other times when the presence of an integrally formed hinge creates problems such as when placing the container in a dishwasher and/or during storage when the containers and lids are stored separately.

As a consequence of the foregoing situation, there has existed a longstanding need for a new and improved detachable hinge system for container wherein a hinge member can be selectively engaged and disengaged between the container receptacle and the container lid, and the provision of such a construction is a stated objective of the present invention.

BRIEF SUMMARY OF THE INVENTION

Briefly stated, the detachable hinge system that forms the basis of the present invention comprises in general, a lid unit, a receptacle unit, and a hinge unit selectively engageable between the lid unit and the receptacle unit.

As will be explained in greater detail further on in the specification, both the lid unit and the receptacle unit are each provided with recesses and the opposite ends of the hinge unit are provided with protrusions which are dimensioned to be frictionally engaged in the recesses to provide an operative and detachable engagement between the hinge unit and both the lid unit and the receptacle unit.

In one version of the preferred embodiment both the lid unit and the receptacle unit are provided with outwardly projecting flanges that are further provided with the recesses dimensioned to receive the protrusions on the hinge unit.

Furthermore, in another version of the preferred embodiment the lip portions of the receptacle unit and the lid unit are provided with the recesses that are dimensioned to receive the protrusions on the opposite ends of the hinge unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
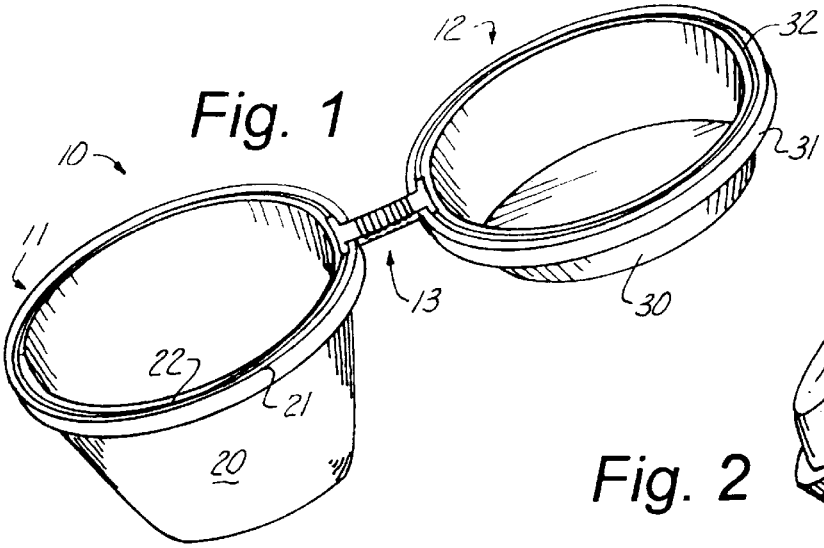
FIG. 1 is a perspective view of the first version of the preferred embodiment of the invention with the lid unit and receptacle unit in an open position.
Figure 2:
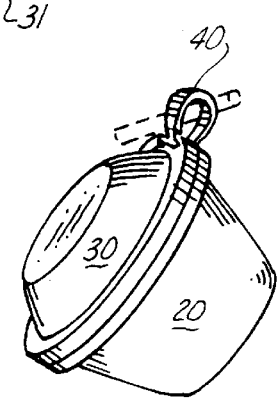
FIG. 2 is a perspective view of the version depicted in FIG. 1 with the lid unit and receptacle unit in the closed position and being suspended from a support.

As can be seen by reference to the drawings, and in particularly to FIG. 1, the detachable hinge system that forms the basis of the present invention is designated generally by the reference number 10. The hinge system 10 comprises in general a receptacle unit 11, a lid unit 12, and a hinge unit 13. These units will now be described in seriatim fashion.

Figure 3:
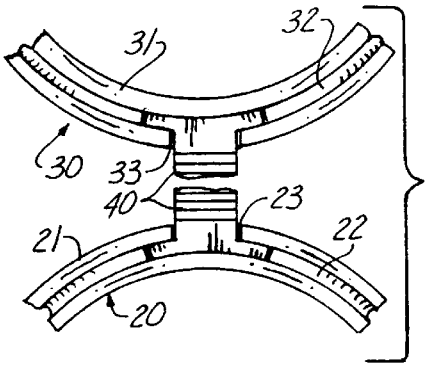
FIG. 3 is an isolated detail view of the operative engagement between the hinge unit, the receptacle unit, and the lid unit of the first version.
Figure 6:
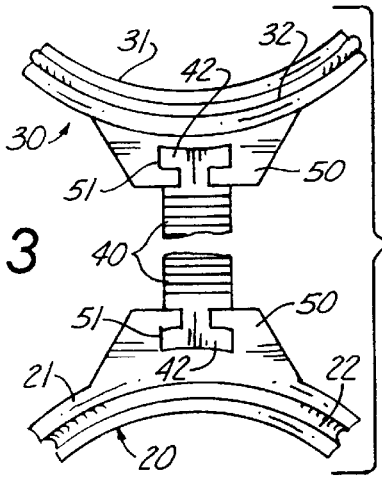
FIG. 6 is an isolated detail view of the operative engagement between the hinge, receptacle, and lid units of the second version of the preferred embodiment.

As can be seen by reference to FIGS. 1, 3, and 6, in both versions of the preferred embodiment, the receptacle unit comprises a receptacle member 20 having an upper lip portion 21 provided with a peripheral groove 22. The lid unit 12 comprises a lid member 30 provided with a lower lip portion 31 having a raised peripheral tongue 32 dimensioned to be received in the peripheral groove 22 in the receptacle member 20 for sealingly engaging the lid member 30 to the receptacle member 20 in a well recognized fashion.

Figure 4:
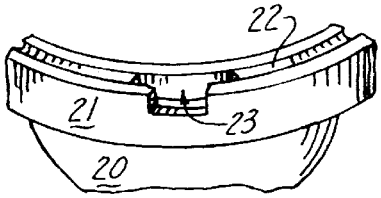
FIG. 4 is an isolated front perspective detail view of the recess in the receptacle unit of the first version.
Figure 5:
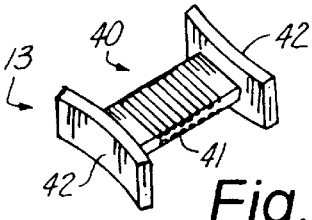
FIG. 5 is an isolated detail view of the first version of the hinge unit.

Turning now to FIGS. 3 through 5, it can be seen that in the first version of the preferred embodiment, the lip portion 21 of the receptacle member 20 is provided with a discrete recess 23 which intersects the peripheral groove 22 in the receptacle member 20, and peripheral lip portion 31 and the tongue 32 of the lid member 30 are provided with a generally T-shaped recess 33 whose purpose and function will be explained presently.

Still referring to FIGS. 3 through 5, it can be seen that the hinge unit 13 comprises a hinge member 40 including a segmented flexible strap portion 41 wherein the opposite ends of the strap portion 41 are provided with protrusions 42 that are dimensioned to be received in the recesses 23, 33 in the receptacle member 20 and the lid member 30, respectively, to operatively engage the lid member 30 to the receptacle member 20.

Figure 7:
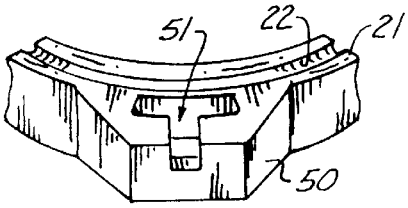
FIG. 7 is an isolated front perspective detail view of the recess in the receptacle unit of the second version.
Figure 8:
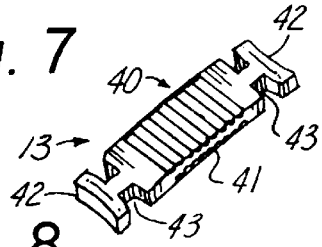
FIG. 8 is an isolated detail view of the second version of the hinge unit.

In the second version of the preferred embodiment depicted in FIGS. 6 through 8, it can be seen that both the lid member 30 and the receptacle member 20 are provided with outwardly projecting flanges 50. Each flange 50 is further provided with a generally T-shaped recess 51 whose purpose will be described presently.

Furthermore, as shown in FIG. 8, the protrusion 42 formed on the ends of the segmented strap portion 41 of the hinge member 40 has a generally T-shaped configuration by virtue of the reduced neck 43 that is formed intermediate the protrusions 42 and the main body of the strap portion 41 of the hinge member.

By now it should be appreciated that both versions of the preferred embodiment require that the lid member 30 and the receptacle member 20 are provided with recesses 23 and 33 in the first version and 51, 51 in the second version that are dimensioned to frictionally engage the protrusions 42 on the opposite ends of the strap member 40 to form an operative detachable connection between the lid member 30 and the receptacle member 20.

At this juncture, it should also be noted that this invention also encompasses a reversal of parts scenario wherein the lid member 30 and the receptacle member 20 are both provided with protrusions and the opposite ends of the strap member 40 is provided with recesses dimensioned to receive the protrusions.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A detachable hinge system for containers comprising:

a receptacle unit including a receptacle member having an upper lip portion provided with a first recess, and a peripheral groove which is intersected by said first recess;

a lid unit including a lid member having a lower lip portion provided with a second recess; and a hinge unit including a hinge member having a flexible strap portion wherein the opposite ends of the flexible strap portion are provided with protrusions that are dimensioned to be received in said first and second recesses.

2. The hinge system as in claim 1 wherein the upper lip portion of the receptacle unit and the lower lip portion of the lid member are both provided with outwardly projecting flanges wherein each flange is provided with a contoured recess.

3. The hinge system as in claim 2 wherein the protrusions on the opposite ends of the flexible strap portion of the hinge member are contoured and dimensioned to be received in the contoured recesses in said outwardly projecting flanges.

4. The hinge system as in claim 3 wherein both the contoured protrusions and the contoured recesses have a generally T-shaped configuration.

5. The hinge system as in claim 1 wherein said lower lip portion is provided with a peripheral tongue dimensioned to be received in said peripheral groove, and said second recess is formed both in the lower lip portion and the peripheral tongue.

* * * * *